US005193315A

United States Patent [19]

Martinez

[11] Patent Number: 5,193,315

[45] Date of Patent: Mar. 16, 1993

[54] METHOD FOR CLEANING A BRAKE ROTOR

[76] Inventor: Ruben E. Martinez, 14601 Mountain Spring, Hacienda Heights, Calif. 91745

[21] Appl. No.: 803,581

[22] Filed: Dec. 9, 1991

[51] Int. Cl.[5] ..... B24B 23/00; B24B 1/00

[52] U.S. Cl. ..... 51/281 SF; 51/205 R; 51/DIG. 3

[58] Field of Search ..... 51/281 R, 281 SF, DIG. 3, 51/259, 205 R, 211 R, 161, 181 R, 211 H; 81/121.1, 177.1, 489

[56] References Cited

U.S. PATENT DOCUMENTS

| | | | |
|---|---|---|---|
| 3,521,411 | 7/1970 | Hennig et al. | 51/281 R |
| 4,262,452 | 4/1981 | Lopez | 51/281 SF |
| 4,269,002 | 5/1981 | Venere et al. | 51/281 SF |
| 4,336,730 | 6/1982 | Kopecko et al. | 51/DIG. 3 |
| 4,361,988 | 12/1982 | Gramlich | 51/281 SF |
| 4,691,599 | 9/1987 | Schultz | 81/489 |

FOREIGN PATENT DOCUMENTS

| | | | |
|---|---|---|---|
| 1255784 | 12/1971 | United Kingdom | 51/281 R |

OTHER PUBLICATIONS

Popular Mechanics, 1961, p. 195 "Spinner Handle".

*Primary Examiner*—Bruce M. Kisliuk
*Assistant Examiner*—Bryan Reichenbach
*Attorney, Agent, or Firm*—Edgar W. Averill, Jr.

[57] ABSTRACT

A tool for cleaning a brake rotor and the method of using the same. The tool has two parts, one for cleaning the rotor surface and the other for turning the rotor surface. The tool for cleaning the rotor surface has a generally U-shaped handle with a pair of abrasive members at each end. The U-shaped tool is held so that its abrasive members contact the surface of the rotor, and the member is then squeezed. The second tool has a socket which is placed over a lug nut, and a straight, cylindrical handle is affixed to the socket. An elongated sleeve is placed loosely over the handle, and the socket is turned in a circular motion so that the rotor is turned thereby moving the rotor against the two abrasive members.

3 Claims, 2 Drawing Sheets

METHOD FOR CLEANING A BRAKE ROTOR

BACKGROUND OF THE INVENTION

The field of the invention is tools, and the invention relates more particularly to tools for servicing motor vehicles and still more specifically to the cleaning of brake rotors.

Disk brakes are becoming ever more common, and although changing the brake shoes on a vehicle having brake drums was a do-it-yourself project, it is often impractical to resurface disk brakes. This is because the brake rotors often have become grooved and coated and must be resurfaced so that the brake pads will have a reasonable service life, and further so that the resurfaced brakes will stop properly.

The do-it-yourselfer often uses an emery cloth to sand the rotor surfaces, but this gets hot, and the job becomes too tedious to do properly.

SUMMARY OF THE INVENTION

It is an object of the present invention to provide tools for facilitating the servicing of disk brakes.

The present invention is for a tool for cleaning a brake rotor comprising a generally U-shaped handle having a base and two arms. The arms are spaced apart such that they can be grasped in the user's hand and squeezed together, and each of the arms has an end. A pair of abrasive holding members is positioned at the end of each arm, and abrasive means are held in the holding members in an inwardly facing manner so that the tool can be held over a rotor. The tool is then squeezed as the rotor is turned so that the abrasive means is forced against the surfaces of the brake rotor thereby cleaning the same. A tool for turning the rotor comprises a socket held on a cylindrical arm. A sleeve is loosely placed over the arm, and when the socket member is secured over the lugs affixed to the brake rotor, the rotor may be easily turned by moving the socket in a circular direction. This is done while the abrasive means is squeezed against both sides of the rotor, thus providing an easy method for the do-it-yourselfer to smooth both sides of a brake rotor in a professional manner.

DESCRIPTION OF THE PREFERRED EMBODIMENTS

Figure 1:
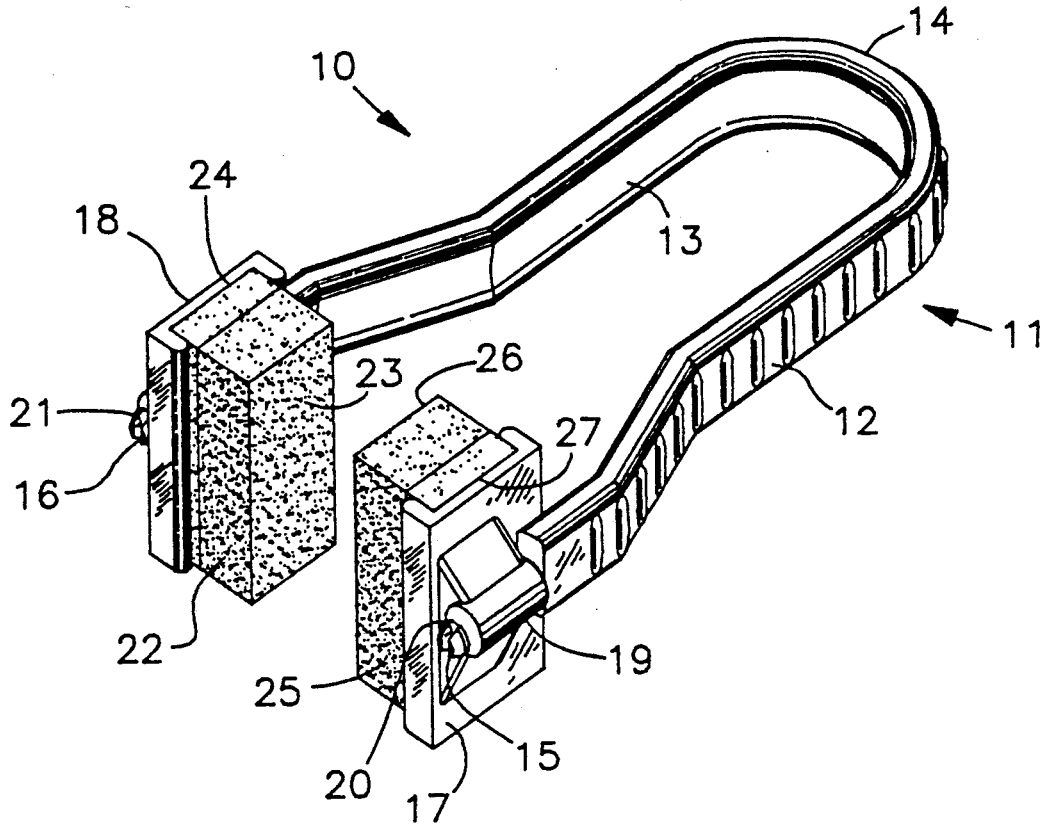
FIG. 1 is a perspective view of the tool for cleaning a brake rotor of the present invention.

A tool for cleaning a brake rotor is shown in perspective view in FIG. 1 and indicated generally by reference character 10. Tool 10 has a generally U-shaped handle 11 which has a pair of arms 12 and 13 joined at a rounded base 14. Arm 12 has an end 15, and arm 13 has an end 16. A pair of stone-holding members 17 and 18 are pivotally affixed to the ends 15 and 16 of arms 12 and 13 Stone-holding member 17 has a collar 19 which is captured by an expandable snap 20. A cylindrical portion, not shown, is under collar 19 and allows the stone-holding member 17 to pivot at the end of arm 11. Similarly, a snap 21 is formed at the end of arm 13 which similarly holds a collar which is a part of stone-holding member 18. Stone-holding member 18 holds a sharpening stone 22 which has a rough surface 23 and a smoother surface 24. Sharpening stone 22 may be removed from stone-holding member 18 and reversed so that its smooth side 24 faces outwardly so that the rotor may be surfaced as desired depending upon the positioning of the sharpening stone. Similarly, sharpening stone 25 has a rough surface 26 and a smoother surface 27 and is also removable and may be inserted in either orientation in stone-holding member 17. Preferably, the generally U-shaped handle is formed from a flexible plastic such as polyvinyl chloride, ABS or other relatively rigid, yet flexible material.

Figure 2:
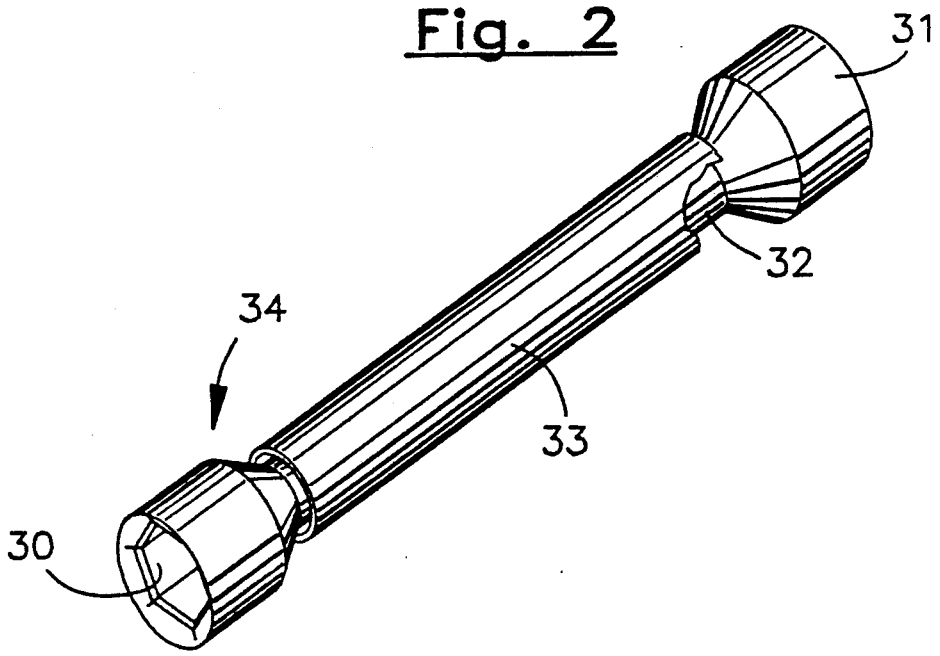
FIG. 2 is a perspective view of the tool for turning the brake rotor of the present invention.

A tool for facilitating the turning of the rotor is shown in perspective view in FIG. 2 and has a pair of sockets 30 and 31 held together by a straight, cylindrical handle 32. An elongated sleeve 33 loosely surrounds the handle 32 and permits the socket wrench member 34 to be turned as indicated in FIG. 3.

Figure 3:
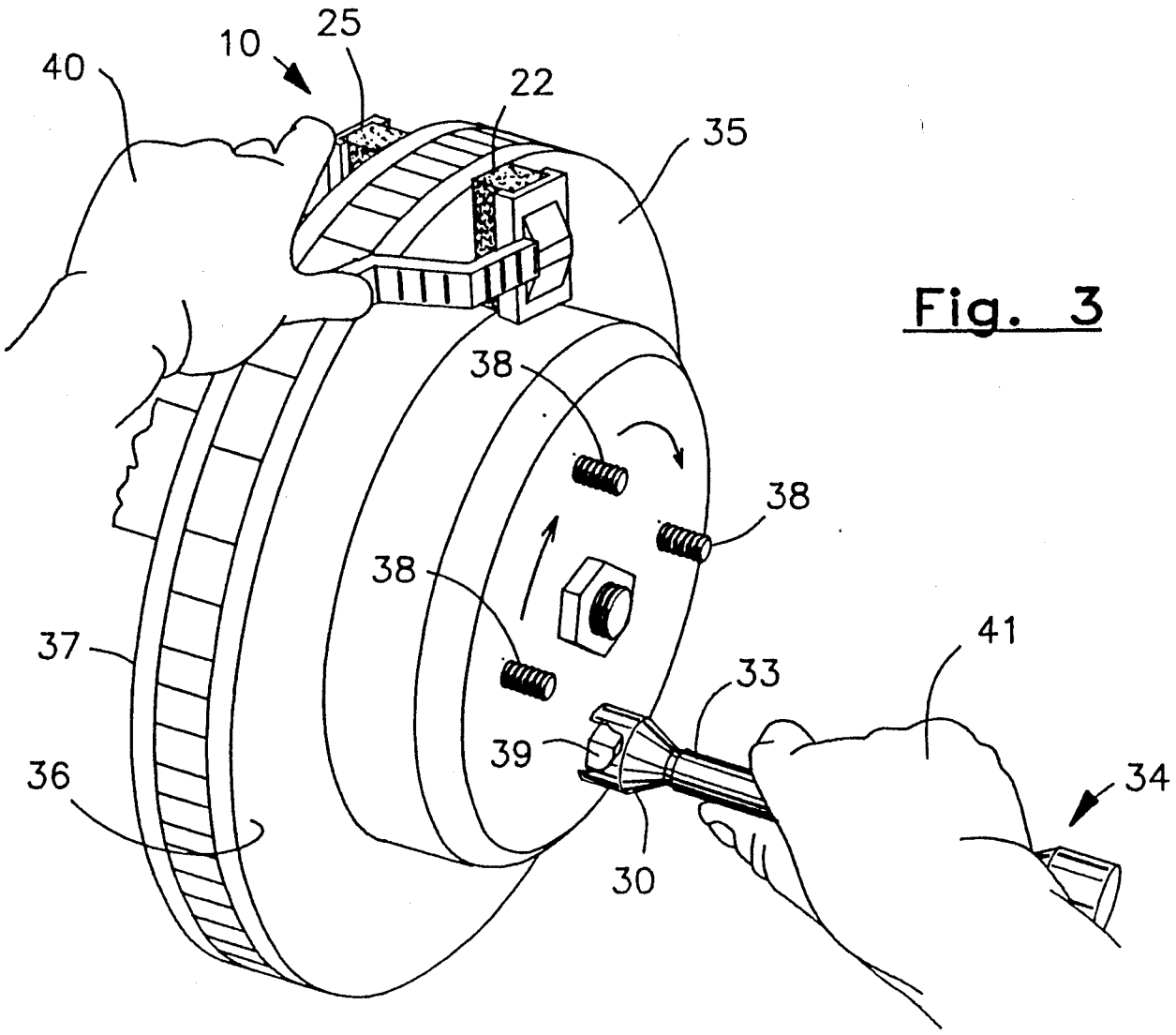
FIG. 3 is a perspective view showing the tools of FIGS. 1 and 2 in use.

Turning now to FIG. 3, the brake rotor 35 has an outer surface 36 and an inner surface 37, and a plurality of lugs 38 are affixed thereto. A lug nut 39 has been screwed over one of the lugs, and socket 30 has been placed over lug nut 39. Tool 10 is grasped by the user's left hand 40, and right hand 41 grasps socket wrench member 34 by its elongated sleeve 33. The rotor is then turned by moving socket wrench member 34 in the direction of arrow 42, thereby causing the rotor 35 to be moved against the sharpening stones 22 and 25. The arms 12 and 13 of the generally U-shaped handle 11 are squeezed by left hand 40, thereby forcing the sharpening stones 22 and 25 against the inner and outer surfaces 37 and 36 of rotor 35, thereby preparing it for receiving the new brake pads.

Of course, the rotor can be turned either counterclockwise or clockwise depending upon the direction in which the lug nuts 39 are tightened. Also, hand positions will be reversed according to the side of the vehicle being cleaned.

Socket wrench member 34 may be fabricated either from a rigid plastic material or from metal. It does not need to have very high strength, however, and the rigid plastic is preferred. The elongated sleeve should turn easily over handle 32 to facilitate the turning of the rotor. The elongated sleeve should typically be fabricated from a rigid plastic such as a rigid polyvinyl chloride polymer.

While sharpening stones have been shown as the abrasive member, of course other abrasive means could also be used. The stone-holding members could, instead, hold emery cloth or other abrasive material. The use of the device of the present invention permits the do-it-yourselfer to easily and professionally resurface both sides of the rotor, thereby providing a surface which will safely perform its braking operation.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A method for cleaning a used brake rotor by hand, said brake rotor being of the type having a plurality of wheel lugs extending therefrom comprising:

placing a lug nut on one of the wheel lugs;

inserting a socket member having an elongated, cylindrical handle over the lug nut;

pressing a pair of abrasive means over said rotor; and moving the socket member in a circular direction thereby turning the rotor and moving the abrasive means against the surfaces of the rotor.

2. The method for cleaning a used brake rotor of claim 1 wherein a cylindrical sleeve is placed over said elongated cylindrical handle before the moving step.

3. The method for cleaning a used brake rotor of claim 1 wherein said pressing step is carried out by squeezing a generally U-shaped member having a pair of ends and having a pair of sharpening stones mounted at the ends of said generally U-shaped member.

* * * * *